US007198696B2

(12) United States Patent
Eriksson et al.

(10) Patent No.: US 7,198,696 B2
(45) Date of Patent: Apr. 3, 2007

(54) METHOD FOR MANUFACTURING PAPER WITH A CONSTANT FILLER CONTENT

(75) Inventors: Kent Börje Eriksson, Husum (SE); Oskar Nordin, Örnsköldsvik (SE)

(73) Assignee: M-real Corporation, Espoo (FI)

( * ) Notice: Subject to any disclaimer, the term of this patent is extended or adjusted under 35 U.S.C. 154(b) by 537 days.

(21) Appl. No.: 10/433,661

(22) PCT Filed: Dec. 7, 2001

(86) PCT No.: PCT/FI01/01069

§ 371 (c)(1),
(2), (4) Date: Jul. 1, 2003

(87) PCT Pub. No.: WO02/46525

PCT Pub. Date: Jun. 13, 2002

(65) Prior Publication Data

US 2004/0060678 A1 Apr. 1, 2004

(30) Foreign Application Priority Data

Dec. 8, 2000 (SE) ..... 0004528

(51) Int. Cl.
*D21F 11/00* (2006.01)

(52) U.S. Cl. ..... 162/198; 162/190; 162/263; 162/252; 162/336; 700/128

(58) Field of Classification Search ..... 162/198, 162/190, 263, 252, 336; 700/128
See application file for complete search history.

(56) References Cited

U.S. PATENT DOCUMENTS 6,521,089 B1 * 2/2003 Griech et al. ..... 162/198

FOREIGN PATENT DOCUMENTS

WO 99/27182 A1 6/1999
WO 99/27183 A1 6/1999

* cited by examiner

*Primary Examiner*—Mark Halpern
(74) *Attorney, Agent, or Firm*—Kubovcik & Kubovcik

(57) ABSTRACT

A method of controlling the production of filler-containing paper. Filler and retention agent are delivered to a paper manufacturing system in a process of paper manufacture. The amount of filler in the paper is measured, as is also the filler concentration or the total concentration in the white water or the stock. Filler is delivered such that the system will be buffered with filler to a generally pre-determined concentration level. The continual addition of retention agent is based exclusively on the amount of filler in the paper measured at that moment in time. When the measured amount of filler present is lower than a desired level, the addition is increased. When the measured amount of filler present is higher than a desired level, the addition is reduced. The continual addition of filler is based, exclusively on the concentration level of filler measured in the white water or the stock.

11 Claims, 2 Drawing Sheets

METHOD FOR MANUFACTURING PAPER WITH A CONSTANT FILLER CONTENT

This application is a 371 of PCT/FI01/01069 filed 7 Dec. 2000.

TECHNICAL FIELD

The present invention relates to a method for producing paper with a constant filler content.

The invention is applicable in the production of any type of paper that contains a filler and a retention agent. The filler content may range from a very low level to a high level, for example from one or a few percent to up to 30%, of the total weight of the paper. With respect to weight, the retention agent content is much lower than the filler content, normally only a fraction thereof, and generally has a given relationship with respect to the filler content.

Paper is mainly comprised of pulp fibres. Pulp may be produced mechanically, chemimechanically and chemically. Lignocellulose material, including softwoods and hardwoods, is used as the starting material in the production of pulp. A typical pulp furnish is comprised of different pulp fibres in mixture. The pulps may be unbleached, semi-bleached and fully bleached, this latter pulp being the dominating pulp. Recycled fibres may constitute a base in the paper, either completely or partially. The pulp may, at times, include an admixture of synthetic fibres. The paper may include one or more other ingredients in the form of paper chemicals. Examples of common such additives are starch, hydrophobising agent, nyancing colours and fluorescent whitening agent. Some papers are subjected to after treatment. Examples of after treatment are surface sizing, coating, and calendering.

Examples of types of paper that can include a filler are fine paper, i.e. non-coated and coated writing paper and printing paper, security paper, liner, label paper, formula paper and envelope paper. Wood containing printing paper, such as newsprint and magazine paper may also contain a filler.

BACKGROUND ART

A primary reason for providing paper with a filler is to improve certain properties of the paper. One important property in this way is the opacity of the paper, i.e. the non-transparency. Certain fillers improve the brightness and/or the whiteness of the paper. One example of such a filler is PCC (precipitated calcium carbonate), i.e. precipitated calcium carbonate. The filler can also improve the surface smoothness of the paper, resulting in improved printability. In addition, the majority of fillers are significantly cheaper per unit weight (kilogram or tonne) than pulp fibres. This is particularly the case in relation to fully bleached chemical pulps. The admixture of filler thus leads to a reduction in paper manufacturing costs. It is worth noting that there is a risk in using filler, and then particularly in large quantities, as the strength of the paper is impaired to a greater or lesser extent in comparison with paper that includes no filler.

The manufacture of paper that contains a filler commences with the production of a thick pulp suspension. This suspension can be produced in different ways. In the case of paper manufacture based on dry pulp in bale form, the pulp is slushed in water, usually white water taken from the long circulation, such as to obtain a thick pulp suspension. In the case of paper manufacture based on pulp in suspension form that is delivered through a conduit to the paper mill from an adjacent pulp mill, the suspension is usually de-watered initially, for instance from a consistency of about 2% to about 15%, so as to obtain a coherent pulp cake. The resultant water, free from pulp fibre, is sent back to the pulp mill through a conduit for renewed use as a vehicle for feeding fresh pulp fibres to the paper mill. The pulp cake obtained in the paper mill is broken-up and mixed with white water from the long circulation, so as to obtain a thick pulp suspension.

The pulp fibres in the form of a thick pulp suspension are normally subjected to a beating process prior to their further advance in the system. If the pulp furnish includes, for instance, two different pulps, these pulps are usually each beaten separately before mixing the two pulp suspensions together.

Relatively large quantities of paper broke are obtained in the following paper manufacturing process. There are several causes why paper broke is obtained. A constantly dominating cause is because the outer edges of the advancing paper web are cut away as a matter of routine. Scrapping is another cause, i.e. the paper produced does not fulfil periodically the quality requirements placed on the paper. A third cause can be that the advancing paper web breaks-off for some reason or other. Such broke paper is normally passed back to the paper manufacturing chain, after having been slushed in white water in broke pulpers. Because this starting material in the form of paper broke contains a filler, the resultant thick pulp suspension will also contain a filler. The amount of paper broke concerned may be as high as 40%, and even higher, which is, in itself, a problem. However, a more difficult problem in this connection is that the amount of paper broke normally varies with time. This means that the filler content of the incoming thick pulp suspension will also vary with time.

The thick pulp suspension is diluted with white water batch-wise on its way to the short circulation and to the head box. One or more paper chemicals can be delivered to the thick pulp suspension on such suspension diluting occasions. Significant dilution f the pulp suspension with white water takes place at the beginning of the short circulation, for instance in the wire pit, so as to obtain a stock that has a low solids substance content. Fresh filler can be delivered to the pulp suspension at several positions, for instance to the thick pulp suspension or to the stock immediately downstream of the wire pit. The retention agent can be delivered to the pulp suspension at described positions, and also later on in the short circulation, i.e. closer to the head box.

The dominant part of the liquid phase in the pulp suspension is comprised of constantly circulating white water. However, a permanent or temporary white water deficiency can be made up with fresh water.

The majority of fillers are in particle form that have a very small surface area (e.g. a diameter smaller than 10 μm) in relation to the surface area or the size of pulp fibres (having a length of, e.g., 3000 μm and a-width of, e.g., 30 μm). There is a relatively small chance of the filler fastening in the paper web by itself or being spontaneously taken-up by the web. When forming the paper on the wire cloth, practically all pulp fibres will fasten on the cloth and form a bed or network thereon. The number of holes in the network is determined by many factors, among other things by the type of paper producing process applied precisely in the paper machine and also the weight per unit area or grammage of the paper produced. There is a direct connection between an increase in grammage and an increase in the thickness of the pulp fibre bed. It is natural that an increase in pulp fibres bed thickness will result in an increase in the amount of filler that is taken up. However, the spontaneous adsorption or retention of filler is insufficient to provide the desired content of filler in the paper. It is therefore necessary to add one or more substances or chemicals that assist in incorporating filler in the pulp fibres bed and therewith in the wet paper web as it leaves the wire and, e.g. is fed into a press section of the paper machine. The wet paper web is transferred to an endless felt in conjunction therewith. This substance or chemical is designated a retention agent. The use of a retention agent results in comparatively more filler remaining in and accompanying the paper web, and comparatively less filler slipping through the pulp fibres bed and down through the wire cloth and into the wire tray together with the drainage water or white water. Despite the use of a retention agent, and then even in large amounts, only a minor part of the filler present in the stock fed into the head box and thereafter spread on the wire cloth will fasten in the paper web, whereas a major part of the filler will accompany the drainage water as it passes through the paper web and the underlying wire cloth. This means that the amount of filler in the white water is still relatively high and is very large when seen in respect of the total amount of filler in the entire system (and then primarily in the large volume of white water that circulates in both the short circulation and the long circulation).

On the basis of the described circumstances, it will readily be seen that it is difficult to control the production of filler-containing paper in a manner such that the final product, i.e. the finished paper, will constantly and persistently contain the desired filler content or filler consistency, for instance expressed in a given percentage value. The buyer and the user of the paper are interested in that the quality of the paper being always the same, and it is important in this respect that the filler content of the paper is always the intended content and that this filler content is achieved constantly from batch to batch.

In order to enable the manufacture of paper to be controlled in the above-described respect, there have long been used measuring operations that are carried out with the aid of a certain type of measuring apparatus. One of these measuring operations involves determining the filler content of the advancing paper web, normally at the end of the paper machine, by means of a non-destructive measuring process, said filler content sometimes being referred to as the ash content. Another measuring operation involves determining the filler concentration of the white water either in the short circulation or in direct connection therewith. Alternatively, the filler concentration is determined together with the low quantity of pulp fibres that are already present in the white water (total concentration). The two measuring processes are normally carried out intermittently, at intervals ranging from, e.g., only a few seconds to, e.g., thirty seconds between respective measuring occasions.

In conventional control technology, both the addition of retention agent and the addition of filler are varied in the course of making the additions. The amount of retention agent added is based on precisely the amount of filler measured in the white water, and the amount of filler added is based on the measured content of filler in the paper web. It has been found that this control philosophy leads to a relatively significant variation in the filler content of the finished paper. Because the filler content of an accepted paper is only allowed to vary within a narrow range, the paper that must be scrapped becomes much too excessive. Moreover, as a result of this control philosophy, the switch from one filler content to another in the paper, for instance from 15 to 19 percent or vice versa, becomes unnecessarily extended time-wise and therewith necessitates unnecessarily the scrapping of much of the paper. The earlier described problem caused by varying amounts of filler in the incoming thick pulp suspension is not overcome completely by the described control philosophy. The attempt to correct a newly measured excessively low amount of filler in the finished paper with an increased addition of filler to the thick pulp suspension for instance, or to the stock is doomed to failure to some extent, since the total amount of liquid, chiefly white water, in the system is, as a whole, very large, meaning that the amount of circulating filler is also large and also meaning that an instantaneous increase in the amount of filler added to the system is unable to become quickly effective in respect of an increase of the filler concentration in the circulating liquid system, which, in turn, would result in a higher quantity of filler fastening in and being retained by the paper web. Such a system is extremely slow to control for these reasons.

Finnish Patent Application 97 4327 and its corresponding International (PCT) Patent Application WO 99/27182 describes, among other things, a method which is alleged to afford advantages in the form of faster and more effective control of the paper properties in the short circulation of the paper machine, in relation to known techniques. By paper properties is meant primarily the filler content of the paper. It would appear that the method concerned is based on the aforedescribed known technique, which has been supplemented with an incompletely explained process in which both the continuous addition of filler and the continuous addition of retention agent are both based on the measured concentration of filler in the white water and the measured filler content or ash content (which is the term used) of the paper.

DISCLOSURE OF THE INVENTION

Technical Problem

As mentioned above, the technology used hitherto for controlling the filler content in the manufacture of filler-containing paper results in excessively high variations in the filler contents obtained. The application of such technology also results in excessively long changeover times when changing from one filler content in the paper to another. Both of these deficiencies result in the scrapping of excessively large quantities of finished paper.

The Solution

The present invention provides a solution to these problems and relates to a method for producing paper with a constant filler content, wherein the method comprises a) passing a thick pulp suspension, containing water, pulp fibres, normally filler originating from slushed paper broke and normally diverse paper chemicals, in a direction towards the head box of a paper machine;
b) adding water, normally white water, to the thick pulp suspension on its way to the head box, so as to form a stock;
c) adding at least one filler to the thick pulp suspension and/or to the stock and/or to the water addition;
d) adding at least one retention agent to the thick pulp suspension and/or to the stock and/or to the water addition;
e) spreading out a finally prepared stock over a wet apparatus, normally a wire section, via, the head box, so as to form a wet paper web, and collecting the water drained from the web, designated white water, beneath the wet apparatus, and passing said white water back in the paper manufacturing process for supplying said water to fresh thick pulp suspension, normally divided and included in two liquid-based flows-of material, designated the short circulation and the long circulation respectively;

f) causing the wet paper web to leave the wet apparatus and thereafter typically pressing and drying the web in at least one stage and optionally subsequently treating the web and/or collecting the web on rolls or converting the web into sheets; and g) measuring the filler content of the paper in some position;

h) measuring the concentration of filler or the concentration of filler plus pulp fibres (the total concentration) in the white water or in the stock preferably in a position in the short circulation or in direct connection therewith, characterised by adding the filler in an amount such as to buffer the system with filler to a normally predetermined concentration level (control value), said level being evaluated via measurement process (h);

basing the continuing addition of filler exclusively on the level of the filler concentration measured in the white water or in the stock, and increasing the amount of filler added when the measured level is below the control level and reducing the amount of filler added when the measured level is higher than the control level at least when seen in the long term, so that the white water system or the buffer system will always make accessible sufficient filler to ensure that the paper web will take-up the intended amount of filler; and by basing the continuing addition of retention agent exclusively on the amount of filler measured in the paper (g) at that moment in time, and increasing the amount of retention agent added when the measured amount of filler in the paper is lower than the level that shall be held constant, and reducing the amount of retention agent added when the level is higher than the level that shall be held constant, therewith resulting in fast correction of the filler content of the paper back to the level that shall be held constant.

With regard to the filler, any known filler can be used. It is quite possible to use more than one filler. The filler or fillers can be supplied in one or more positions. It is usual that one filler is used and that the total amount of filler is supplied to the stock in a position at the beginning of the short circulation. There is nothing to prevent the filler addition being divided into two or more quantities, for instance into two part-quantities, of which one is delivered, to the thick pulp suspension and the other to the stock. It is optional whether or not the additions of the two part-quantities are varied in the course of the addition, or whether the addition of one part-quantity is fixed or constant and the addition of the other part-quantity is varied in the course of the addition sequence. Examples of fillers are kaolin clay, calcium carbonate (either in the form of substances that occur naturally, such as limestone, marble and chalk or newly produced substances in the form of PCC), titanium dioxide and talcum.

The amount of filler charged to the system per unit of time is dependent of a number of factors, and a differentiation must be made between when filler is added in the start-up stage in the manufacture of filler-containing paper and when filler is added in a steady state. If paper that contains a high filler content, e.g. 20%, is produced in a steady state, a large amount of filler is constantly taken from the liquid system or the white water, this filler entering and accompanying the wet paper web and because it is necessary to compensate the liquid system for the filler taken therefrom, at lest in the long term, it is necessary to add a large amount of filler in said position or positions. When paper broke is used as part of the starting material which is a normal case (in addition to freshly supplied pulp fibres), already the incoming thick pulp suspension will contain a relatively large amount of filler. The amount of filler present will vary with the amount of paper broke in the total amount of starting material and also on the amount of filler present in the paper broke concerned, for instance 10 versus 20%. The amount of filler that shall be added at a given point in time may be, and often is, partly dependent on the circumstance just described. There is no absolute requirement for the addition of a given amount of filler on each addition occasion, in order for the invention to function. This is because of the presence of a filler buffer in the system, and the only absolute necessity is that the buffer system always has available sufficient filler for the intended amount of filler to be taken-up in the paper web. This will be described also further on in the text.

The filler is added by initially slurrying the filler in a liquid, for instance white water, and then delivering the liquid together with its filler content to the advancing pulp fibre suspension or to the water in said possible positions, with the aid of a regulator or with the aid of several regulators which operates/operate in accordance with the described control philosophy. The regulator or regulators may be implemented in a computer program or may be constructed mechanically, or may consist of electronic components.

Also regarding retention agent any known such agent whatsoever maybe used. It is fully possible to limit the use to a single retention agent that is delivered to the system at one or more positions. It may be beneficial to use more than one retention agent, for instance two retention agents. These agents may be added in one and the same position, although there is nothing to prevent each retention agent from being added to the system in a respective position. Both additives may be varied in the course of making the additions, likewise that one addition amount can be kept constant, while the other addition amount is varied time after time according to the need. Distinct from the position, in which the filler is added to the system, it may be beneficial to add at least a part of the requisite retention agent relatively far forward in the short circulation, i.e. relatively close to the head box. Examples of retention agent are inorganic retention agents and synthetic water-soluble organic polymers.

Examples of inorganic retention agents are alun, bentonite clay and silica sols and diverse silicates. Examples of synthetic water-soluble organic polymers are polyacryl amide, polyethylene amine, and polyamine. The polymers may be cationic, anionic and nonionic polymers. The aforesaid paper chemical starch, which is available in a number of different forms, is sometimes included in the retention agent group. It can at lest be maintained that the presence of starch in the system influences the retention of filler.

The amount of retention agent charged to the system per unit of time is also dependent on several factors. Generally speaking, when producing paper that has a high filler content, more retention agent will be consumed than when producing paper of low filler content. One reason for this is because when producing filler-containing paper there occurs a spontaneous retention that is not influenced directly by the presence of a retention agent. It can be mentioned in this connection that the spontaneous retention does not slavishly follow the presence of filler in the system and, e.g., the concentration of filler in the white water, even though this concentration normally increases with increasing concentration of filler in the white water. As before mentioned, this spontaneous retention is influenced by the grammage or weight per unit area of the paper produced, and therewith also by the thickness of the pulp fibre bed or pulp fibre network forming the base in the paper web. The spontaneous retention is also influenced by the type of paper machine used. The amount of filler which is present in the paper and which has not been included via spontaneous retention is present due to and with the aid of the retention agent supplied to the system. Distinct from the case of filler, the system is not buffered with retention agent when this substance is added, but that an increase in the addition of retention agent results almost instantaneously in an increase in the amount of filler incorporated in and fastening in said paper or paper web. This is the reason of why, or a contributory factor of why, it is possible to produce persistently a filler-containing paper with a substantially constant filler content, as will be exemplified further on in the text. If it is chosen to set the amount of retention agent charged to the system per unit of time in relation to the amount of filler charged per unit of time, it will be found that there is not any direct relationship nor yet any relationship that varies uniformly. However, it can be said broadly that the weightwise addition of retention agent lies within the range of some tenths of a percent to about five percent of the addition of filler to the system. The mentioned relationship is primarily dependent on the filler content of the paper and on the type of paper.

The retention agent addition is effected by initially slurrying and/or dissolving the retention agent in liquid, for instance white water, and delivering said liquid with its retention agent content to the advancing pulp fibre suspension or the water in said possible positions with the aid of a regulator or with the aid of several regulators which operates/operate in accordance with the described control philosophy. The regulator or regulators may be implemented in a computer program or constructed mechanically or comprised of electronic components.

The apparatus that measures the filler content of the paper may be placed anywhere adjacent the paper web, from the place at which a paper web is formed in the wire section to the place where the finished paper is rolled onto a roller or bobbin at the end of the paper machine. There are apparatus that are mounted in a fixed position adjacent the advancing paper web and apparatus that traverse said web. The measuring apparatus may be placed very conveniently in a position where drying of the paper web is complete and where the web thus has a dry solids content in excess of 90%.

Any type of known measuring apparatus may be used. There is described below a type of measuring apparatus that is used typically in the production of filler-containing paper.

The apparatus is comprised of two parts, a transmitter part placed beneath the paper web for instance, and a receiver part placed above the web for instance. X-rays emitted by the transmitter part pass through the paper web and up into the receiver part, where said rays are converted to electric current of given voltage. Some of the X-rays passing through the paper web collide with filler particles and are absorbed thereby, resulting in the number of X-rays received by the receiver differing from the number of X-rays emitted by the transmitter. The more filler particles present in the paper web, the more X-rays that will be absorbed and the weaker the electric current leaving the receiver and measured as a weaker voltage. The measured voltage difference is in relation to the difference in the amount of filler in the paper, for instance given as a percentage of the grammage of the paper. Examples of measuring apparatus that operate in accordance with the described principles are Honeywell 2237-xx x-ray Ash Sensor and ABB Accuray, Smart2-Component and 3-Component Ash Sensors.

The described measuring apparatus that include a transmitter part and a receiver part can be fixedly mounted, i.e. such that measuring is effected on solely one place of the advancing paper web. Alternatively, both the transmitter part and the receiver part may be mounted on a shuttle, such as to move synchronously with one another across the advancing paper web and therewith measure across the fill width of the web.

The filler content of the white water or the stock may also be measured by means of any known appropriate measuring apparatus. A description of a type of measuring apparatus used typically in the manufacture of filler-containing paper is described below.

The measuring apparatus includes, among other things, a transparent measuring cell. A given volume, e.g., white water is caused to flow through the cell per unit of time. Polarised laser light, that is to say light of one and the same wavelength in one and the same plane, is sent through the white water flow, which contains a large quantity of filler particles and a small quantity of pulp fibres, or rather fibre fragments. Part of the light rays impinge on the filler particles and the fibres/fibre fragments and rebound back and to the side in certain angular paths, these paths being dependent on the type of material on which light rays impinge. Located immediately after the light emitting location and in front of the measuring cell are light sensitive detectors, which capture the light rebounding at different angles. It is the light back scatter and the extinction at different angles that is determined. The concentration of filler in white water for instance, can be determined in this way.

It is also possible to determine the total concentration of solid material in, e.g., white water by means of a measuring operation. This is achieved by measuring the amount of polarised laser light that succeeds in passing through the white water unchanged, and by comparing this quantity of light with the amount of polarised laser light emitted. The larger the amount of solid substances in the white water, the more transmitted polarised laser light that is disturbed and becomes depolarised.

KAJAANI RM-200, KAJAANI $RM_i$ and BTG REG-5300 is one example of measuring apparatus that functions in accordance with the above described principles.

Although the present invention finds its optimal application in paper manufacturing processes in which some of the starting material is always comprised of filler-containing paper broke, the invention can also be applied with certain advantages in respect of the manufacture of filler-containing paper whose starting material contains no paper broke.

Advantages

One decisive advantage afforded by the inventive method is that it results in surprisingly low deviations from the desired filler content of the paper. Consequently, the amount of paper that must be scrapped because of an error in filler content, is extremely low.

These low deviations in the filler content of the paper produced also enables the control value to be set to a higher value than has hitherto been the case, when wishing to produce paper that has a high or a very high filler content. As before mentioned, high filler contents result in a reduction in the strength of the paper in relation to paper that contains no filler. It is not the strength of the finished and converted paper that is of primary interest, but the strength of the paper web advancing in the paper machine. An excessively low web strength can result in repeated breaks in the web, which, in turn, results in a high volume of paper broke and in low production of prime paper. When applying present-day control technology, the filler content swings about a desired mean value quite significantly in both directions. When desiring a paper filler content that is only one or more percentage points from the critical filler content at which the advancing paper web can break at typical present-day very high machine speeds, it is elected to place the control value on the desired filler content when practising conventional control technology, despite everything. This is done in order to ensure that as much as possible of the paper produced shall have a filler content that does not lie outside the accepted spread range. It should be noted in this respect that the spread downwards in filler content is not permitted to deviate more than the upward spread in filler content. The small variation in the filler content of paper produced in accordance with the present invention results in allowing the filler content control value to be laid in the upper half of the accepted spread range. The ability to control persistently the filler content so that said content will increase on average by only one percentage point has an immediate effect with respect to paper manufacturing costs.

A similar advantage is also obtained at lower filler contents in the paper which are not dangerous from a strength aspect i.e. the control value may also then be laid in the upper half of the accepted spread range which results persistently in a slightly higher filler content of the paper, therewith lowering paper manufacturing costs.

It has also been found that the inventive control method has a much higher immediate effect than conventional control technology, leading to a short transition time in switching from one filler content to another in the paper produced.

The low variation desired in the filler concentration in the white water and achieved in accordance with one preferred embodiment of the present invention, provides a smoother paper manufacturing sequence and also results in fewer breakdowns in the paper manufacturing process.

BEST EMBODIMENT

The inventive method will now be described partially in more detail with reference to the flowchart of FIG. 1, and finally with reference to an exemplifying embodiment.

Figure 1:
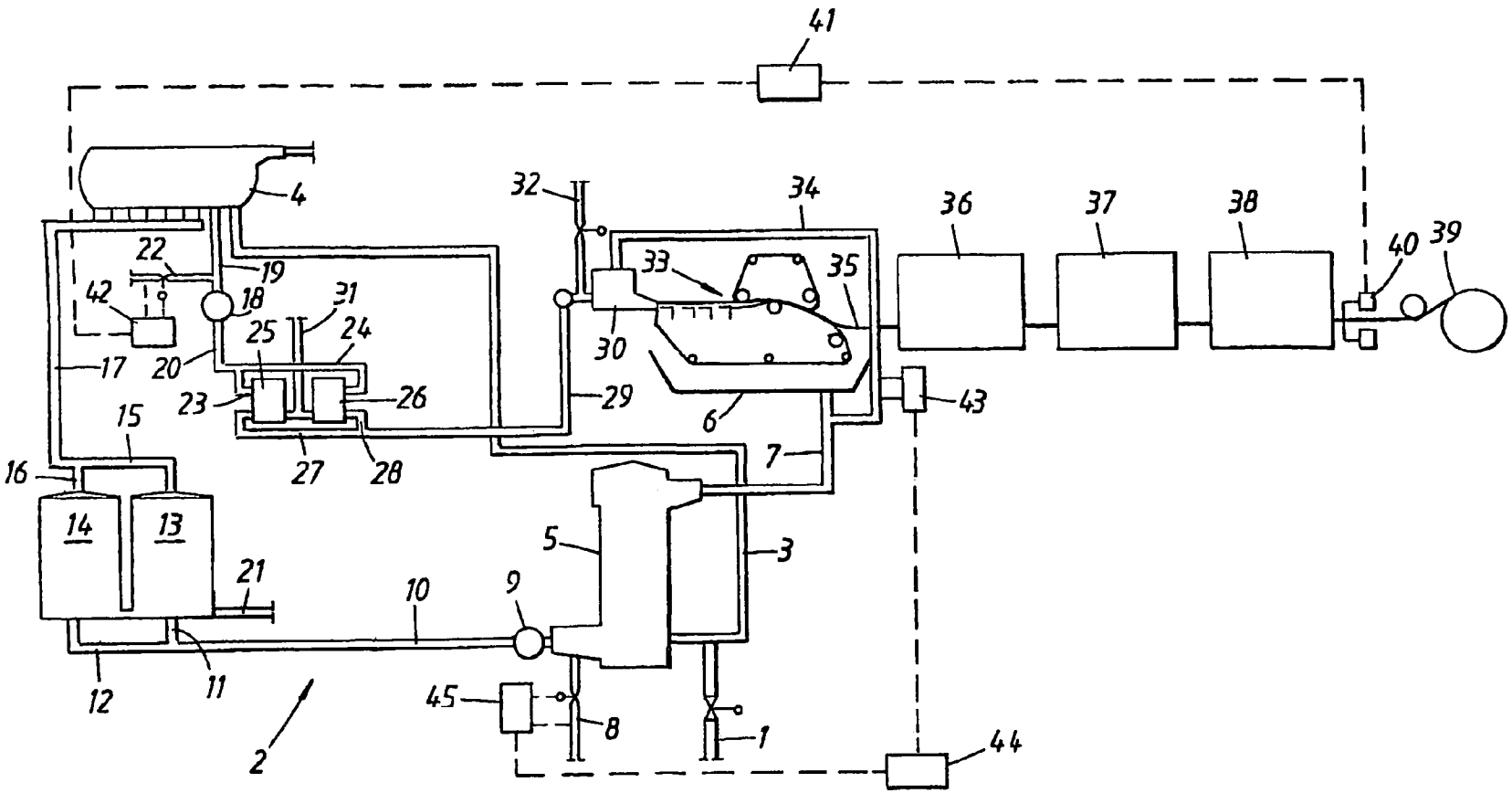
FIG. 1 is a flowchart, which illustrates application of the inventive method in the manufacture of filler-containing paper.

FIG. 1 is a schematic illustration of one embodiment of the inventive method.

A thick pulp suspension is fed into the short circulation 2 through the conduit 1. The thick pulp suspension contains pulp fibres (whether or not one type of pulp fibre or several, e.g. two, types of pulp fibres is included will depend on the type of paper to be produced), water (predominantly white water) filler (originating from the paper broke slurry) and one or more paper chemicals. The thick pulp suspension fed into the short circulation 2 through the conduit 1 may have a pulp concentration of 2 to 4%.

The thick pulp suspension is introduced in the conduit 3, which contains white water originating from a deaeration tank 4. The thick pulp suspension is therewith diluted and fed into the wire pit 5. The pulp suspension is diluted further with white water in the pit, said water being passed from the wire tray 6 to the wire pit 5 through the conduit 7. This results in a stock. The thick pulp suspension delivered through the conduit 1 is sometimes referred to as the stock, including by certain persons skilled in this art. Although such language usage is not wrong, we have chosen in this document to differentiate between thick pulp suspension and stock in order to be able to describe the inventive method in a simpler and more readily understood manner.

Fresh filler is fed to the stock in the form of an aqueous dispersion to the outlet of the wire pit 5, through the conduit 8. The amount of filler added is determined primarily by the desired filler content of the finished paper. The method in which the addition of filler is regulated in detail will be explained further on in the text. Different types of filler have been exemplified in the aforegoing, and the filler chosen in the individual case is dependent on several factors.

The stock is passed further through the conduit 10, by means of the pump 9. Because the filler is delivered close to the pump 9, the filler will be effectively mixed with and distributed in the stock. Branch conduits 11 and 12 pass the stock to a respective battery 13 and 14 of vortex cleaners or hydrocyclones. Accept pulp is passed through the branch conduits 15 and 16 and through the conduit 17 to the aforesaid deaeration tank 4. Reject is recovered and passed through the conduit 21 to a separate handling facility, which is not discussed here. The stock is delivered to the tank 4 through a large number of dipper conduits. As the name denotes, the stock is deaerated in said tank 4 and stock is passed from the tank in a substantially air-free state and containing a certain amount of white water (this latter being mentioned earlier) further along the system. A foam damping chemical can be delivered to the stock upstream of position 4, with the intention of limiting foaming of the stock.

The stock is fed to a screening operation by means of the feed pump 18, via the conduits 19 and 20. A first retention agent is delivered to the stock in conduit 19 immediately upstream of the pump 18, through the conduit 22. The retention agent may be slurried in or dissolved in white water. Each of the branch conduits 23 and 24 feed the stock to a respective screen 25 and 26. Accept pulp is fed to the head box 30, through the branch conduits 27 and 28 and through the conduit 29. Reject obtained in the screening operation is recovered and passed through the conduit 31 to a separate handling facility, which is not described here. A second retention agent is delivered to the stock in conduit 29 immediately upstream of the head box 30, through the conduit 32. This retention agent may be slurried or dissolved in white water. This results in an essentially final or finished stock.

The stock is distributed over a wire in a wire section 33, with the aid of the head box 30. The solid substance concentration of the stock, essentially comprised of pulp fibres, ranges from 0.5 to 1.5 percent in the described position. Concurrently with the formation of a paper web on the wire, a large amount of liquid or water is drained-off both gravitationally and with the aid of suction boxes. This liquid or said water, designated white water, is collected in the wire tray 6. Part of the white water taken from the wire tray 6 to the wire pit 5 through the conduit 7 is drawn-off through the conduit 34 and returned to the head box 30 for final dilution of the stock inside the head box 30 and in a particular part thereof.

The resultant, coherent paper web 35 is passed to a press section 36 and thereafter to a pre-dryer 37 and then to an after-dryer 38, whereafter it is finally rolled-up on a reeling drum (tambour) 39.

The content of filler in the finished paper, for instance given in a percentage of the weight of the paper, is determined intermittently by means of a measuring apparatus 40, which may be a traversing type in accordance with what has earlier been described. The measurement signal, i.e. the measured filler content, is sent to a filler content regulator 41, which sends a signal to a flow regulator 42 that controls the flow of retention agent t be supplied via the conduit 22. More specifically, the valve seated in the conduit 22 is controlled in a known manner to open wider when desiring a higher flow of retention agent and to close accordingly such as to reduce the through-passage of retention agent when desiring a reduction in the flow of retention agent. The flow regulating system also includes a flow meter by means of which it can be ensured that the desired amount of retention agent will actually flow through the conduit 22. In order to minimise disturbances in the filler content during a change in the production of the paper machine, metering of the retention agent can be given a feed-forward signal so that it will automatically follow the change in production. An increase in production requires an increase in the amount of retention agent metered to the system. The feed-forward facility is designed so that a given percentage change in production will result in the same percentage change in the amount of retention agent metered to the system. This takes place over and above the described control relating to the measured filler content of the paper.

There is coupled to the conduit 34, through which white water flows, an apparatus 43 for intermittently measuring the filler concentration and/or the total concentration in the white water. A typical measuring apparatus includes a transparent measuring cell through which a very small volume of white water is caused to flow. The manner in how measuring is effected has been described in more detail earlier. A signal which describes, e.g. the measured filler concentration in grams per liter of white water is sent from the measuring apparatus 43 to the filler concentration regulator 44. A signal is sent from the regulator 44 to a flow regulator 45, which controls the flow of filler to be delivered to the system, via the conduit 8. This regulator 45 operates in a similar manner to the regulator 42 and also includes a flow meter in this case.

In order to minimise disturbances in the filler concentration of the white water during a change in the production of the paper machine, the filler flow can be given a forward-feed signal so that it will automatically follow changes in filler requirement. Increased production r an increase in the c ntrol value in respect of filler in the paper gives, in the long run, a need to increase the amount of filler metered to the system. By multiplying the production of the paper machine by the control value for the filler content of the paper, there is obtained a value for calculated filler consumption. The feed-forward coupling is designed so that a given percentage change in the calculated filler consumption will also give the aforedescribed adjustment in respect of the measured concentration of filler in the white water.

In the case of the described embodiment of the invention, only one filler is supplied (at position 8), whereas two retention agents are supplied (at positions 22 and 32). With regard to the retention agent supplied at position 32, which agent may consist of bentonite clay for instance, the amount of agent supplied has been chosen to have a fixed value, i.e, one and the same flow of retention agent is supplied to one and the same flow of stock The magnitude of this fixed charge of retention agent will depend on a number of factors, such as on the desired amount of filler in the finished paper and the amount of filler charged to the system per unit of time, and also on the magnitude of the amount of supplementary retention agent charged to the system at position 22. When using bentonite clay as retention agent, it has been found that an optimal effect is obtained when said agent is added to the system as close as possible to the head boy.

With regard to the retention agent in position 22, which agent may, for instance, comprise a synthetic water-soluble organic polymer, the amount of agent charged varies in accordance with requirements. It has been found that in order to obtain a good effect with such a retention agent, the agent should be charged to the system immediately upstream of the feeder pump. 18, as shown in FIG. 1. Although it is fully possible to add the retention agent earlier in the flow direction within the short circulation, there is a risk that the retention agent will then take several paths and be recycled, therewith causing the agent to lose electric charge and not being utilised optimally in the paper forming process, i.e. in the wire section 33.

In accordance with the earlier described control philosophy, the varying addition of retention agent in position 22 is effected in the following way.

When wishing to produce a paper that includes a given filler in a given quantity, for instance 21% it is known through experience that a given approximate flow of filler must be delivered through the conduit 8. It is also known through experience that in the current conditions, it is suitable to add a given retention agent to the system in a fixed amount, via the conduit 32. It is also known from experience what the approximate. addition of said second retention agent shall be, via the conduit 22. When the paper manufacturing process is well underway, the filler content of the finished paper is measured at short intervals in position 40. If these measurements show that the filler content or concentration of the paper is, for instance, 21.5% instead of 21.0%, the control function is activated. The measured value is sent in signal form from position 40 to the filler content regulator 41, and said filler content regulator 41 sends to the retention agent flow regulator 42 a signal which indicates that the flow of retention agent shall be decreased to a certain extent, because the measurement just taken shows that the filler content of the paper is slightly too high. The reduced supply of retention agent to the stock is quickly effective in reducing the adsorption of filler in the paper web being formed on the wire, therewith obtaining the desired filler content of 21% in the paper. If the measured filler content is lower than that desired, for instance 20.5%, the flow of retention agent is increased through the conduit 22 to a corresponding degree. The increase supply of retention agent to the stock quickly becomes effective in an increased adsorption of filler in the paper web on its way being formed on the wire, therewith obtaining the desired filler content of 21% in the paper.

In order to achieve the aforedescribed, the filler concentration in the system, including in the white water, need not have a fixed relationship with the amount of retention agent added to the system and the content of filler in the paper produced, since it is also possible to maintain a correct filler content in the paper when the continual addition of filler over a longer period of time is excessively low and results in a constant reduction in filler concentration in the white water. There is, of course, a lower limit for depletion of filler in the buffer system.

The structure of the filler content regulator 41 is known to the art. A feedback regulator is normally used. The most common type of regulator is designated PID regulator and operates exclusively on the basis of "control error" e, and the following relationship prevails between control error e and control signal u;

$$u = K\left[e + T_D\frac{de}{dt} + \frac{1}{T_1}\int^{t} e(s)\,ds\right]$$

The control signal is composed of three terms, where P denotes the proportional term, which is proportional to the error, D denotes the derivative term, which is proportional to the derivative of the error, and 1 is the integral term, which is proportional to the derivative of the error. This is taught, for instance, in a booklet form Lund's Teknisska Högskola entitled "Reglerteknik, en elementär introduktion", written by Karl Johan Åström. The different terms are combined additively in the formula. A desired function is set in the regulator, by adjusting the three constants K, $T_1$ and $T_D$. A number of different methods are available for adapting these constants to the process to be regulated. One usable method is designated the Lambda method.

As earlier mentioned, the flow of filler through the conduit 8 is essentially at least partially dependent of the filler content of the paper produced in other words the amount of filler that is constantly adsorbed by and incorporated in the paper web formed on the wire in the wire section 33.

The filler concentration of the white water is checked at given intervals with the aid of the measuring apparatus 43. Normally, the desired level of the filler concentration in the short circulation is one and the same for a given paper quality. This has to do with the runability of the paper machine. It has been found beneficial with respect to the running of the paper machine to maintain the filler concentration in the system, including the filler concentration of the white water, constant over the passage of time. The control value may, for instance, be 4 grams per liter. If the measured value is 3.8 grams per liter, this value is sent to the filler concentration regulator 44 in signal form. This regulator sends, in turn, to the filler flow regulator 45 a signal to the effect that the flow of filler in the conduit should be increased, which is effected by opening the valve in the conduit 8 connected to the regulator 45 still wider. The flow regulator system also includes a flow meter by means of which it is ascertained whether or not the intended amount of flow actually flows through the conduit 8. If it is found that the value measured is too high, for instance 4.2 grams per liter, the flow of filler through the conduit 8 is reduced to a corresponding degree.

The filler concentration regulator 44 is of a known kind and may be of the same type as that earlier described, i.e. as the regulator located in position 41. The control system constructed around the regulator 44 takes into account that the buffer system for the filler in the short circulation, including all white water, is slow to adjust. In other words, even though the flow of filler is greatly increased in a certain position, it will take a long time before the punctiform significant increase in filler will result in an increase in the filler concentration in the total, very large, volume of white water. The control program for the regulator 44 is generally similar to the control program for the filler content regulator 41 described above.

As will be seen from the flowchart illustrating the production of filler-containing paper in accordance with FIG. 1, the long circulation based on white water (for instance taken somewhere along the conduit 7) is not included, and neither are all the work-up stations for the thick pulp suspension delivered to the short circulation through the conduit 1. This has been excluded for reasons of scope and clarity.

EXAMPLE 1

The inventive method has been tested in a paper machine of a kind that coincided to a large extent with the flow chart according to FIG. 1, for the production of filler containing fine paper. Comparisons were made with conventional technology for the production of such paper;

A thick pulp suspension was fed through the conduit 1 at a flow rate of 16,500 liters per minute. The starting material for the thick pulp suspension was 60% fresh pulp delivered from an adjacent pulp mill, and 40% paper broke. In turn, the fresh pulp comprised 65% birch sulphate pulp having a brightness of 90% ISO, and 35% pine sulphate pulp having a brightness of 90% ISO. Each of the two fresh pulps were refined per se before being mixed in a mixing vessel, into which the slushed paper broke was also fed. The paper broke had a filler content of about 21.5%, and the filler comprised precipitated calcium carbonate (PCC). The incoming thick pulp suspension thus contained a significant amount of filler, which can be readily estimated. Stock starch was added to the thick pulp suspension on its way to the conduit 1.

Fresh filler in the form of 52 percentage PCC was delivered through the conduit 8 at an approximate flow rate of 90 liters per minute. The filler density was 770 grams per liter. Small quantities of a number of colour tints were added at the same time. Additional paper chemicals, including fluorescent whitening agent, were added further forward in the short circulation.

A first retention agent in the form of a synthetic polymer having a density of 4 g/l was delivered through the conduit 22. The flow rate of this retention agent was, on average, about 50 liters per minute.

A second retention agent in the form of bentonite clay having a density of 35 grams per liter was delivered to the system via the conduit 32. The flow rate of this retention agent was fixed and constituted 30 liters per minute throughout.

The stock leaving the head box 30 had a solid substance content of 0.9–1.0%. The control value for the filler content of the finished paper was 21.5%, and the weight per unit area of the paper was 80 grams per square meter. The machine speed was about 970 meters per minute, resulting in a production of about 30 tonnes of paper per hour. The finished paper had a moisture content of about 4.5%.

The paper was surface sized in a film press at a position late in the paper manufacturing chain. The surface size was applied in an amount corresponding to about 4 grams per square meter. Although no film press has been shown in the flowchart of FIG. 1, the press was placed immediately downstream of the pre-dryer 37 in the paper machine concerned.

Figure 2:
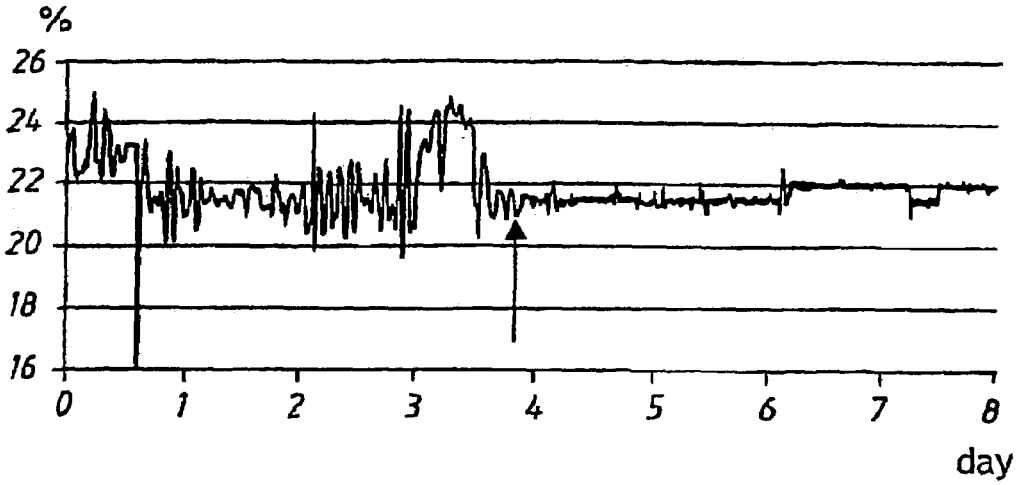
FIG. 2 is a diagram illustrating in percent the filler content of paper produced in accordance with conventional technology and in accordance with the invention.

FIG. 2 illustrates the filler content of the finished paper over four calendar days when using conventional technology in producing filler-containing paper, and also the filler content of the, finished paper over a following four calendarday period when using inventive technology in the production of filler-containing paper.

By conventional technology is meant, among other things, that the filler content of the paper is measured in position 40 and also the filler concentration in the white water at position 43. However, the measured filler content of the paper is not used to control the addition of retention agent in position 22 but is used for controlling the addition of filler at position 8. The control was carried out so that if the measured value of the filler content of the paper was higher than the desired value, i.e. the control value, the flow of filler was reduced in position 8, whereas if the measured value was too low, the flow of filler was increased in position 8. Moreover, the flow of retention agent in position 22 was controlled so that if the filler concentration in the white water, i.e. in position 43, was higher than the control value, the flow of retention agent was increased in position 22, whereas if the measured value of the filler concentration was too low, the flow of retention agent was reduced in position 22.

The filler content of the finished paper when applying the aforedescribed conventional control technology is shown to the left of the arrow in FIG. 2. As will be seen, the filler content varies greatly around the desired control values. The system has even reached a howling in any occasion.

At the time marked with an arrow in FIG. 2, a departure from the aforedescribed conventional control technology was made, insofar as the signal for the measured filler content of the paper at position 40 was sent to the filler content regulator 41, which, in turn, sent a signal to the retention agent flow regulator 42 in accordance with the FIG. 1 illustration and in accordance with the inventive control technology described above in detail. When applying the novel control technology, measuring of the filler concentration in the white water in position 43 was released during the first calendar day from the automatic and computer controlled control system. Instead, metering of filler at position 8 was effected manually by the operators during this calendar day.

It will be seen from FIG. 2 that a control value for the filler content in the finished paper of 21.5% was used over a period of about 2.5 calendar days when practising the invention. The control value was then switched to 22.0%, which was followed by a short period in which the old control value was used, i.e. the value of 21.5%, and the test run was terminated with a control value of 22%.

The superiority of the novel control technology over conventional control technology is clearly evident from FIG. 2. When applying the novel technology, the variation in the filler content of the finished paper is reduced significantly in relation to the old and conventional technology. The standard deviation in the filler content of manufactured paper has been calculated for one calendar day on each side of the arrow in FIG. 2 at a control value of 21.5%. In the case of the traditional control technology, the standard deviation was 0.95 and in the case of the inventive control technology the standard deviation was 0.14, in other words the variation in filler content of the paper was improved almost seven times when practising the inventive control technology.

The automated and computer controlled system for metering filler in position 8 on the basis of the filler concentration measured in the white water in position 43 was activated after about one calendar day. How that works has been described in detail earlier.

Figure 3:
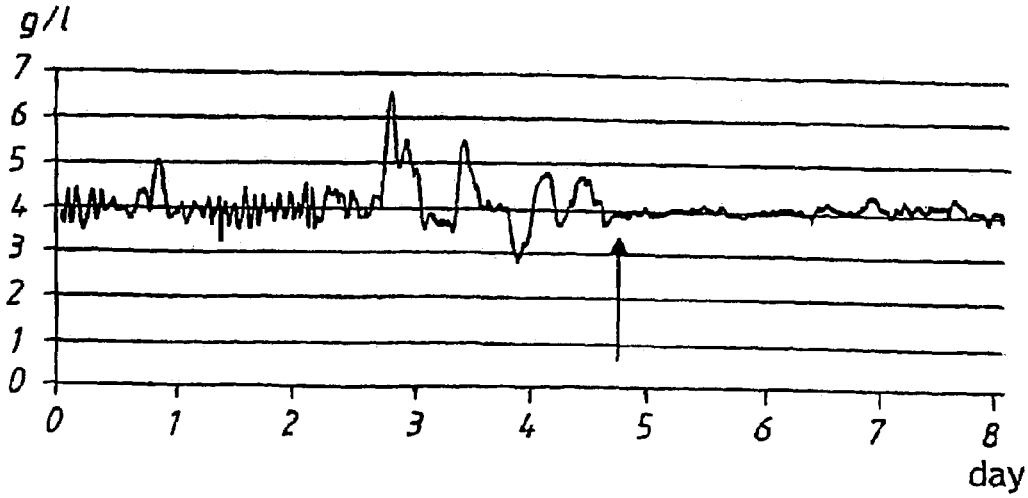
FIG. 3 is a diagram illustrating the filler concentration in the white water in grams per liter in the manufacture of filler-containing paper in accordance with conventional technology and in accordance with one preferred embodiment of the invention.

As will be evident from FIG. 3, the control value was 4 grams per liter both in respect of conventional control technology (to the left of the arrow) and with respect to a preferred embodiment of the inventive control technology (to the right of the arrow). The variation around the control value for the filler concentration also varies in a surprisingly significant manner in this case. It has been found that a low variation around the control value for the filler concentration in the white water is beneficial with respect to the drivability of the paper machine concerned.

In the aforedescribed test run carried out in accordance with the invention, data relating to the filler content of the paper was obtained every twenty seconds, while information relating to filler concentration in the white water was obtained every four seconds. The use of precisely these measuring intervals is in no way mandatory, but that the measuring intervals can be determined individually and are dependent on the type of measuring apparatus used, among other things.

A study of FIGS. 2 and 3 will show that it is not absolutely necessary to begin to control the addition of filler to the system on the basis of the filler concentration measured in the white water in order to obtain an essentially constant filler content in the paper day after day, although such a measure is preferred chiefly for other reasons. In the described test run, control of the filler addition in position 8 in accordance with a preferred embodiment of the invention was not commenced until after one calendar day. Despite this, the paper had the correct filler content after only some ten minutes subsequent to starting the test in accordance with the invention.

When the non-compulsory "second" control was started-up, the addition of filler in position 8 was changed each time the measurement taken in position 43 showed that it was appropriate to do so. In other words, a small change could be made to the flow of filler during long periods each fourth second. It is in no way absolutely necessary to do so, since it is fully possible to make a relatively significant change in the flow of filler on the basis of a given measurement in position 43, over a given period of time which experience has shown will result in a general increase in the filler concentration of the entire system after a given, relatively long period of time, and check that the measurements in position 43 follow a well-known pattern during said time period. Thus, it is not a catastrophe if the flow of filler suddenly ceases in position 8 for some possible unintended reason, and that the supply of filler is stopped for a limited period of time.

In principle, the conditions are different with respect to the addition of retention agent in position 22 in this case, the command given by the control system to increase the flow of retention agent is ignored, the paper will obtain an excessively low filler content during essentially this ignoring period.

It is mentioned in conclusion that there are found curves which are similar to the curve shown in FIG. 2 and which confirm that switching of the filler content in manufactured paper from one level to another can be effected much more rapidly with the inventive technology than with conventional technology. This fact also contributes towards minimising the volume of paper that need be scrapped. The fact that paper is still scrapped is, among other things, due to the fact that quality parameters other than filler content can deviate from set measurement values. The aforesaid curves have not been included for reasons of space and scope.

The invention claimed is:

1. A method for manufacturing paper with a constant filler content, comprising a) passing a thick pulp suspension containing water, pulp fibres, optionally filler derived from slurrying paper broke, and optionally diverse paper chemicals towards a head box in a paper machine;

b) adding further water to the thick pulp suspension on its way to the head box, so as to form a stock;

c) adding at least one filler to at least one of the thick pulp suspension, the stock and said further water;

d) adding at least one retention agent to at least one of the thick pulp suspension, the stock and said further water;

e) spreading finally prepared stock on a wet apparatus via the head box, so as to form a wet paper web, and collecting resultant drainage water, designated white water, beneath the wet apparatus and passing said white water back in the paper production process for delivery to fresh thick pulp suspension divided and included in two liquid-based flows of material designated the short circulation and the long circulation respectively;

f) causing the wet paper web to leave the wet apparatus and then optionally pressing and drying said web in at least one stage and subjecting said web optionally to aftertreatment and/or collecting said web on rolls or converting the web into sheets and g) measuring the filler content of the paper;

h) measuring the concentration of filler in the white water or in the stock; in a position in the short circulation or in direct connection therewith, characterised by adding the filler in an amount such that the system will be buffered with filler to a predetermined concentration level which is the control value, said level being followed via measurement (h);

basing the continuing addition of filler exclusively on the measured concentration level of filler in the white water or in the stock, such that when the measured level is lower than the control value, the addition of filler is increased, and such that when said measured level is higher than the control value the addition of filler is reduced, so that the white water system or the buffer system will always have available sufficient filler to enable the paper web to adsorb the intended amount of filler; and basing the continuing addition of retention agent exclusively on the newly measured amount of filler in the paper (g), so that when the measured amount of filler in the paper is lower than the level that shall be held constant, the addition of retention agent is increased, and so that when the measured amount of filler in the paper is higher than the level that shall be kept constant, the addition of retention agent is reduced, therewith resulting in rapid correction of the filler content of the paper back to the level that shall be held constant.

2. A method according to claim 1 characterised by adding one filler in one or more positions.

3. A method according to claim 1 characterised by adding the total amount of filler to the stock in a position at the beginning of the short circulation.

4. A method according to claim 1, characterised by slurrying the filler in a liquid prior to adding the filler to the system, and by supplying said liquid and its filler content to the advancing pulp fibre suspension or to the water in said position with the aid of a regulator or several regulators.

5. A method according to claim 1, characterised by adding two retention agents to the system in one or more positions.

6. A method according to claim 1, characterised by adding two retention agents to the stock each in a respective position, wherein one retention agent is added at a point located at a short distance into the short circulation in a variable quantity that is dependent on the amount of filler measured in the paper (g), while the other retention agent is added at a point further forward in the short circulation in a constant amount based on the paper production and on the intended filler content of the paper.

7. A method according to claim 1, characterised by slurrying and/or dissolving the retention agent in a liquid prior to its addition to the system.

8. A method according to claim 7, wherein liquid together with its retention agent content is added to the advancing pulp fibre suspension or to the water with the aid of a regulator or several regulators.

9. A method according to claim 1, characterised by measuring the filler content of the paper on the ultimately dried paper web having a dry solid content above 90%.

10. A method according to claim 1, characterised by measuring the filler concentration of the white water in a white water sub-flow taken from the flow of white water transported from a collecting device beneath the wire section, said collecting device being designated a wire tray.

11. A method according to claim 1, characterised by measuring the filler concentration of the stock in a position immediately upstream of the head box or inside said head box.

* * * * *

UNITED STATES PATENT AND TRADEMARK OFFICE

CERTIFICATE OF CORRECTION

PATENT NO. : 7,198,696 B2
APPLICATION NO. : 10/433661
DATED : April 3, 2007
INVENTOR(S) : Kent Börje Eriksson and Oskar Nordin It is certified that error appears in the above-identified patent and that said Letters Patent is hereby corrected as shown below:

Title page, item (30) Foreign Application Priority Data, "0004528" should be --0004528-6--.

Signed and Sealed this

Seventh Day of August, 2007

JON W. DUDAS
*Director of the United States Patent and Trademark Office*